US005711680A

United States Patent [19]

Tsuneaki et al.

[11] Patent Number: 5,711,680

[45] Date of Patent: Jan. 27, 1998

[54] SOCKET TYPE ELECTRIC DEVICE UNIT

[75] Inventors: Tadayoshi Tsuneaki, Kamiichi-machi; Masahide Kanagawa, Toyama; Michio Kurokawa, Tonami, all of Japan

[73] Assignee: Hokuriku Electric Industry Co., Ltd., Kami-Niikawagun, Japan

[21] Appl. No.: 688,428

[22] Filed: Jul. 30, 1996

[30] Foreign Application Priority Data

Mar. 19, 1996 [JP] Japan ..... 8-063132
Apr. 11, 1996 [JP] Japan ..... 8-089602

[51] Int. Cl.[6] ..... H01R 9/09

[52] U.S. Cl. ..... 439/83

[58] Field of Search ..... 439/83, 71, 74, 439/70

[56] References Cited

FOREIGN PATENT DOCUMENTS 60-52563 1/1985 Japan .
6-33621 8/1994 Japan .
7-85442 9/1995 Japan .

*Primary Examiner*—Neil Abrams
*Assistant Examiner*—Eugene G. Byrd
*Attorney, Agent, or Firm*—Pearne, Gordon, McCoy & Granger LLP

[57] ABSTRACT

A socket type electric device unit comprising an electric device including at least one electric device mechanism having an electrical characteristic varied by an operating member and a plurality of connecting terminal members provided on the electric device and a socket to be mounted on a circuit board, the socket having a device insertion hole into which the electric device is to be inserted and a plurality of stationary terminal members provided on the socket to contact the connecting terminal members of the electric device when it is inserted into the device insertion hole.

17 Claims, 5 Drawing Sheets

SOCKET TYPE ELECTRIC DEVICE UNIT

BACKGROUND OF THE INVENTION

This invention pertains to a socket type (or mounted-on-socket type) electric device including a socket soldered and electrically connected to a circuit board and a body of an electric device such as a variable resistor, a variable capacitor or the like to be mounted on the socket.

Conventionally, an art in which an electronic device is automatically soldered and electrically connected to a circuit board by a wave soldering method has been widely used. However, such an electronic device as has a poor heat-resistance or an electric device having a mechanical structure integrally provided therewith to protrude from the bottom face of the circuit board cannot be automatically soldered to the circuit board because of being adversely affected by heat from the molten solder. Thus, heretherto, after the electronic devices which tend to be never affected by the heat from the molten solder are automatically soldered to the circuit board, the electronic devices and the electric devices which tend to be affected by the heat from the molten solder are manually soldered to the circuit board so that they are electrically mounted on the circuit board.

Expensive semiconductor elements such as large scale integrated circuits (LSI) or relays having a high exchange frequency have been mounted on a circuit board by two steps of mounting respective exclusive sockets on the circuit board by an automatic soldering method and of thereafter mounting the semiconductor elements or the relays on the corresponding exclusive sockets.

However, an electric device such as a switch element or a constant variable element of a variable resistor or a variable capacitor having a mechanical structure integrally provided with a body of the electric device to protrude from the bottom of the circuit board cannot be mounted on a circuit board without any soldering through a socket which is soldered to the circuit board. Therefore, such an electric device has been mounted on the circuit board by a manual soldering operation.

Conventional electric devices to be mounted on a circuit board are disclosed in Japanese Utility Model Publication No. 33,621/1994, Japanese Patent Publication Nos. 85,442/1995 and 52,563/1985. Those disclosed electric devices cannot partially protrude from a bottom of the circuit board.

SUMMARY OF THE INVENTION

Accordingly, it is a principal object of the invention to provide a socket type electric device adapted to be mounted on a circuit board through a socket while the electric device partially protrudes from a bottom face of the circuit board.

It is another object of the invention to provide a socket type electric device adapted to be mounted on a circuit board through a socket while a construction of the electric device is easily modified.

It is another object of the invention to provide a socket type electric device adapted to be mounted on a circuit board through a socket while it is accurately positioned on the circuit board.

It is another object of the invention to provide a socket type electric device adapted to be mounted on a circuit board through a socket and including an urging force generating mechanism to generate an urging force by which an operating member for the electric device can be displaced.

It is another object of the invention to provide a socket type electric device adapted to be mounted on a circuit board through a socket while a large force is never applied to the socket when the electric device is mounted thereon or when an operating member for the electric device is operated so that no crack is generated in the socket and also so that a soldered portion of the socket is never damaged.

It is further object of the invention to provide a socket type electric device so constructed that static electricity never enters the electric device mechanism through an operating member therefor.

It is further object of the invention to provide a socket type electric device so constructed that a large force is never applied to a socket when the electric device is mounted on the socket or when an operating member for the electric device is operated partially by means of a tactile feeling or a click feeling generating mechanism and also that static electricity is prevented from entering the electric device mechanism through the operating member.

It is further object of the invention to provide a mounted-on-socket system mechanism type electric device and a socket used therefor adapted to prevent flux for soldering from moving along a surface of a contact terminal of a stationary terminal member when the socket is soldered to a circuit board.

It is further object of the invention to provide a socket type electric device including a socket having a shutter member mounted thereon to prevent a soldering flux from flowing along stationary terminal members provided thereon when the socket is soldered to a circuit board and a socket adapted to be used therefor.

It is further object of the invention to provide a socket having a shutter adapted to prevent a soldering flux from flowing along stationary terminal members provided thereon and to fail to drop off when an electric device is mounted on the socket and a socket type electric device having such a socket.

A socket type electric device of this invention comprises an electric device and a socket. The electric device comprises an operating member, at least one electric device mechanism having an electric characteristic or condition varied by the operating member and a plurality of connecting terminal members each having a contact terminal portion exposed exterior thereof and electrically connected to a plurality of input or output electrodes of at least one electric device mechanism.

At least one electric device mechanism may include a variable resistor mechanism having a slider fastened to an operating shaft of the operating member, a rotary switch mechanism having a movable contact fastened to the operating shaft and a variable capacitor mechanism or the likes. The electric device may comprise a click feeling generating mechanism and/or an urging force generating mechanism applying an urging force to a support of the operating member and the operating shaft of the operating member as well as the aforementioned mechanism.

The electric device has a housing in which at least one electric device mechanism and other mechanism are enclosed. The housing may have one housing part or a plurality of housing parts. For example, the housing may comprise a first housing part in which at least one electric device mechanism is enclosed and a second housing part disposed below the first housing part and in which the urging force generating mechanism to apply an urging force to the operating member is enclosed. Each of the housing parts may be formed of a combination of casings. For example, one of the housing parts may comprise a casing in which is enclosed the click feeling generating mechanism to generate a click feeling as the operating member rotates and at least one casing in which at least one electric device mechanism is enclosed.

The socket comprises a socket body to be mounted on a circuit board, a plurality of stationary terminal members provided on the socket body and having contact terminal portions to contact the contact terminal portions of the connecting terminal members on the electric device mechanism and a soldering terminal portion to be soldered to a soldering land of the circuit board and a device insertion hole provided in the socket body and into which the electric device is to be at least partially inserted.

The contact terminal portions of the connecting terminal members and the contact terminal portions of the stationary terminal members contact with each other when the electric device is inserted into the device insertion hole in the socket body so that the electric device is electrically connected to the socket. The circuit board is required to have a device through hole provided therein corresponding to the device insertion hole in the socket.

In the invention, the device insertion hole in the socket body may be formed of a hole through which the electric device and more particularly the housing thereof is to extend. Thus, the electric device partially projects from the bottom face of the circuit board when the electric device is fully inserted into the device insertion hole. As a result, it will be noted that the electric device can be mounted on the circuit board through the socket while it projects from the bottom face of the circuit board.

The socket body of the socket may be provided with a plurality of protrusions which are to engage a plurality of through holes provided in the circuit board, respectively, so that the socket is positioned relative to the circuit board. With such protrusions provided on the socket body, the socket can be more easily positioned relative to the circuit board.

In case that the socket body is in a rectangular form, the protrusions may be integrally provided on the socket body so as to be positioned on a pair of corners of the socket body on a diagonal line. This enables only a smaller number of protrusions to accurately position the socket.

At least one hook may be integrally provided on the socket body. The hook has an engagement portion to engage an edge of an engagement hole provided in the circuit board so that the socket is prevented from being removed out of the circuit board. Although the hook may be provided on the protrusions for positioning the socket, this will cause the socket to be positioned relative to the circuit board with poor accuracy. Thus, it will be noted that the hook may be preferably provided separately from the positioning protrusions.

In case that the electric device includes the click feeling generating mechanism, that generates a tactile feel when the operating member rotates, the click feeling generating mechanism and the electric device mechanism may be contained in separate casings, respectively. These casings may be connected to each other by connector means such as connecting pins. This may preferably provide the electric device of predetermined construction having the click feeling generating mechanism and one or more than other electric device mechanism combined with each other. As a result, the same click feeling generating mechanism can be commonly used for another electric device. This allows a common use of the parts. These casings form a first housing part and a second housing part in which the urging force generating mechanism is contained may be provided below the first housing part. The casings of the first housing part and the second housing part may be also connected to each other by suitable connector means.

The construction of the housing may be voluntarily determined, there should be provided a base member having a flange or flanges engaging the surface of the circuit board on the side of the operating portion. The housing may have a plurality of engaging portions provided thereon and adapted be able to extend through the device through hole in the circuit board to engage a bottom face of the circuit board so as to hold the circuit board between the engaging portions and the flanges of the base member. This enables the electric device to be securely provided on the circuit board, which is held between the flanges of the base member and the engaging portions of the housing. As a result, the socket may be thinner because of the electric device being not required to be positively supported on the socket. An excessive force is never applied to the socket and the soldered portion thereof through the electric device when it is inserted through the socket or when an operating force is applied to the operating member. This prevents the socket from being cracked or the soldered portion of the socket from having a poor connection.

In case that the shaft of the operating member is formed of electrically conductive material, it may be electrically connected to the base member. This allows static electricity tending to enter the electric device through the shaft portion of the operating member to escape through the base member to the earth of the circuit board. In this case, on the surface of the circuit board should be provided a ground electrode contacting the flanges of the base member. The base member may be preferably disposed on the side of the operating portion of the operating member rather than the electric device because this absolutely prevents the static electricity from entering the electric device mechanism.

The base member may be suitably formed of metal in order to hold the circuit board together with the engagement portions and also in order to make an electrically conductive path therethrough. Since many metals have a wear resistance higher than a synthetic resin, the base member may be preferably partially formed of metal in case of the click feeling generating mechanism provided in the electric device. More particularly, the base member on its surface is provided with a notched or rough face slidingly engaging a contact portion of an electrically conductive clicking slider. With the surface of the base member having the notched or rough face, the base member on its rough face is restrained from being worn, which causes the good click feeling to be obtained over a long time.

The clicking slider is mounted on a rotor of electrically conductive material fitted on the operating shaft so as to be electrically connected to the rotor. This allows the static electricity through the operating shaft to flow through the rotor and the clicking slider to the base member.

With the device insertion hole in the socket body formed of a hole through which the electric device is to extend, when the socket is soldered to the circuit board by an automatic soldering method, a soldering flux will tend to flow into the interior of the through hole, which causes much of the soldering flux to disadvantageously stick to the surfaces of the contact terminal portions of the stationary terminal members. Since the thus stuck flux forms an insulating film, the contact resistance between the connecting terminal members of the electric device and the stationery terminal members gets inconveniently higher. Although the contact terminal portions of the stationary terminal members may be polished after soldering, this disadvantageously causes the steps of operation to increase.

In order to avoid these problems, the socket body of the socket may be provided with a shutter to prevent the soldering flux from flowing through the device insertion hole along the surfaces of the contact terminal portions of the stationary terminal members before the electric device is inserted into the device insertion hole, but to be forcibly opened or bent by the electric device when it is inserted into the device insertion hole.

With such a shutter provided on the socket, the possibility of sticking the soldering flux to the surfaces of the contact terminal portions of the stationary terminal members decreases. Since the shutter may be opened or bent by the electric device inserted into the device insertion hole, the operation of removal of the shutter is not required.

In case that the contact terminal portions of the stationary terminal members provided on the socket body are at least partially positioned at the interior of the device insertion hole, the shutter may be preferably positioned below the contact terminal portions of the stationary terminal members so that the soldering flux is prevented from flowing directly toward the contact terminal portions of the stationary terminal members. This positively prevents the flux from sticking to the contact terminal portions of the stationary terminal members.

The construction of the shutter may be voluntarily determined, but the shutter may preferably comprise at least one door-like member integrally provided on the socket body because the shutter may be more easily provided without preparing any separate parts. The door-like member may be preferably connected to the socket body so that it is never removed out of the socket body far away from the device insertion hole when it is forcibly opened by the electric device inserted into the device insertion hole because the shutter is not required to be disposed of after the electric device is mounted on the circuit board.

The shutter may comprise two door-like members securely provided on the socket body so as to substantially close the device insertion hole. This minimizes the flux moving upwardly through the device insertion hole. The two door-like members may be preferably connected to each other by a breakable connection. With the door-like members connected by the breakable connection, the two door-like members are prevented from moving downwardly before the step of soldering.

BRIEF DESCRIPTION OF THE DRAWING

The above and other objects and features of the invention will be apparent from the description of the embodiments of the invention made with reference to the accompanying drawings in which.

DETAILED DESCRIPTION OF EMBODIMENTS OF THE INVENTION

Figure 1:
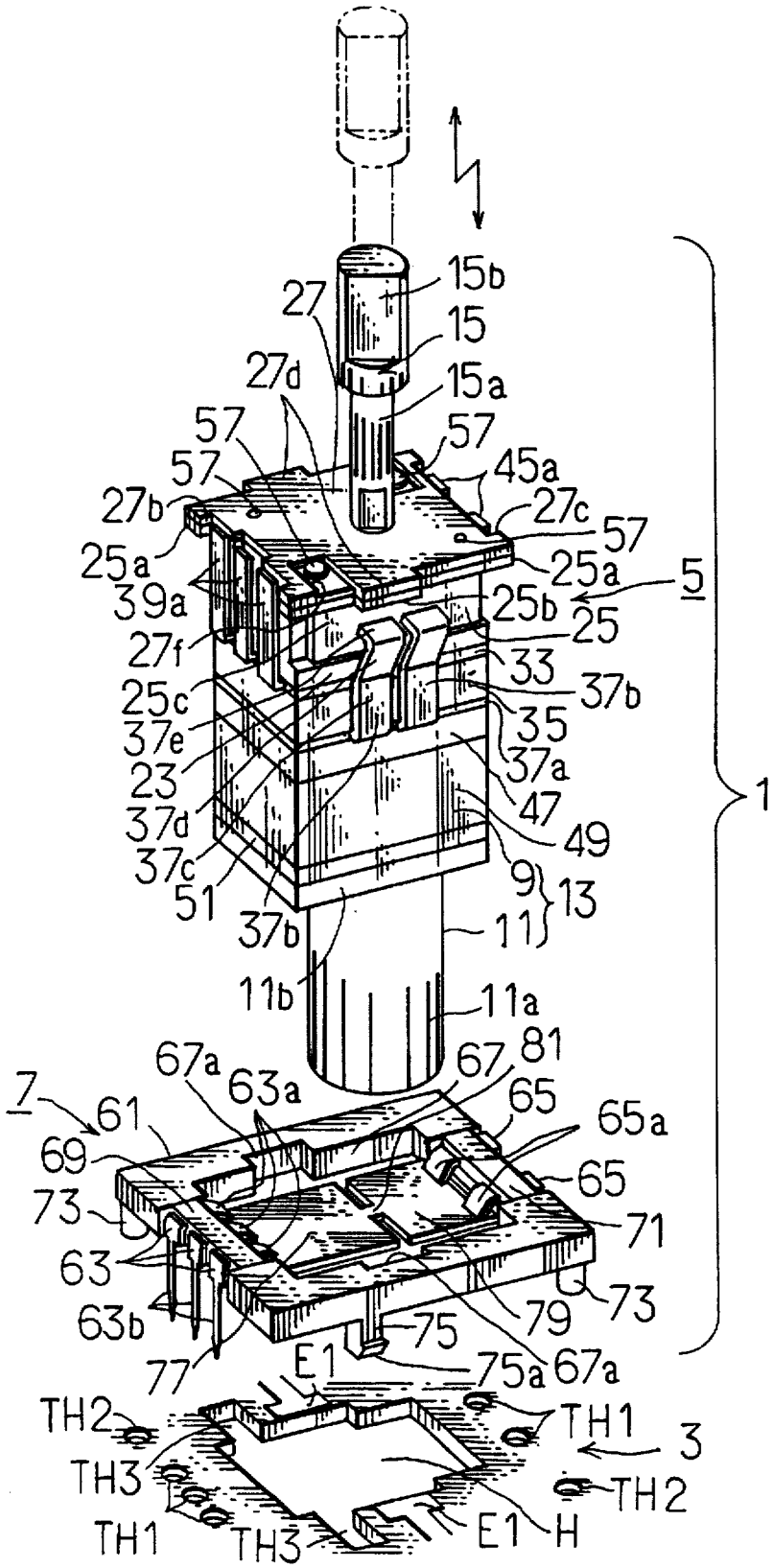
FIG. 1 is an explosive and perspective view of a socket type electric device unit constructed in accordance with an embodiment of the invention with parts thereof aligned with each other although not mounted on a circuit board.
Figure 2:
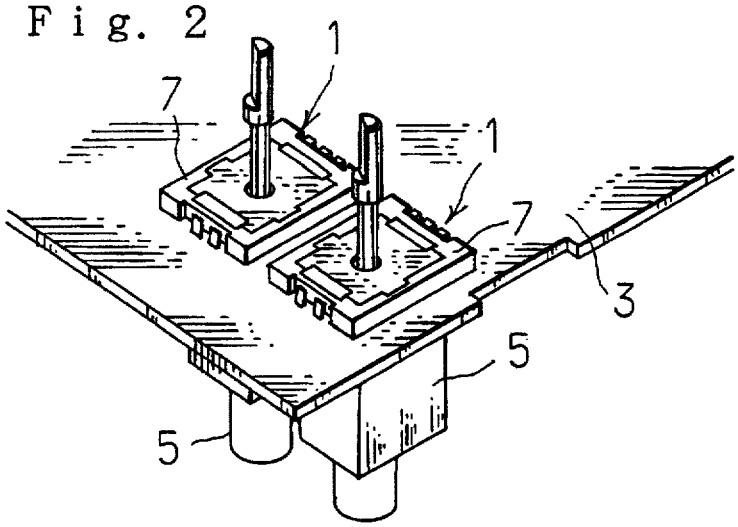
FIG. 2 is a perspective survey view of the units of FIG. 1 mounted on the circuit board.

There is shown in FIG. 1 a unit 1 of a socket type electric device constructed in accordance with one embodiment of the invention to be mounted on a circuit board 3 and in FIG. 2 two units 1 and 1 of a socket type electric device mounted on the circuit board 3 in an perspective view. The units 1 comprise an electric device 5 and a socket 7, respectively.

Figure 3:
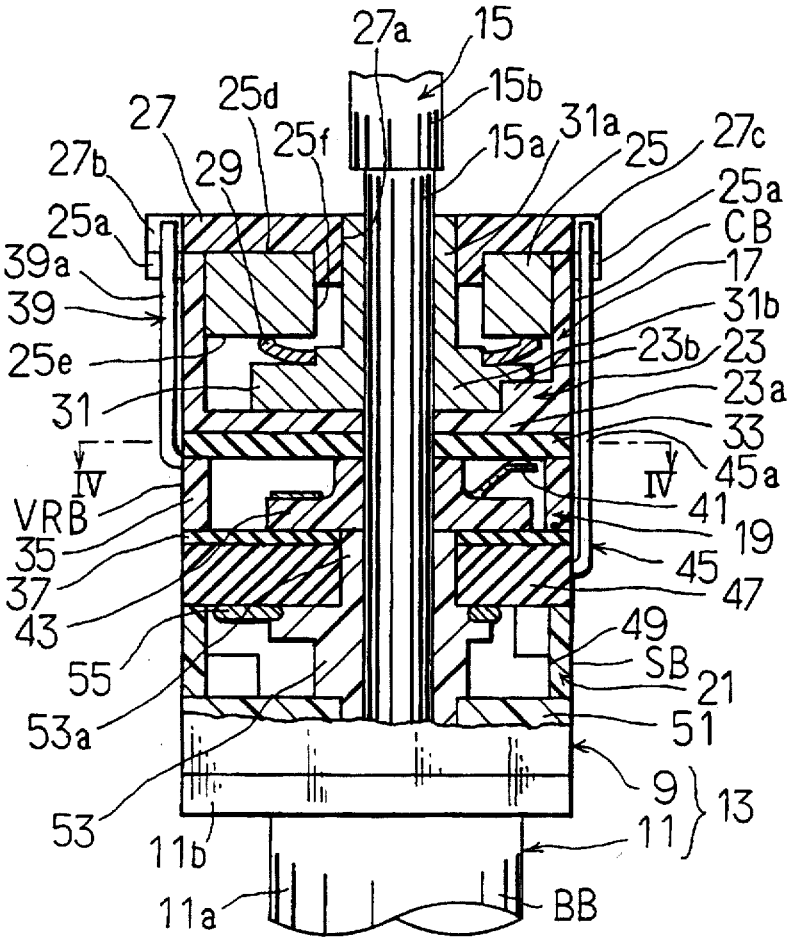
FIG. 3 is an enlarged cross sectional view of the electric device used for the unit of FIG. 1 with a structure thereof shown in an outline.

A structure of the electric device 5 will be described with reference to FIGS. 1, 3 and 4. The electric device 5 comprises a housing 13 including a first housing part 9 in which is contained at least one electric device mechanism and a second housing part 11 in which is contained an urging force generating mechanism applying an urging force to an operating member 15. As shown in FIG. 3, the first housing part 9 may comprise a first casing 17, a second casing 19 and a third casing 21 in combination. The first casing 17 contains a click feeling generating mechanism which generates a click feeling as the operating member 15 rotates. The second casing 19 contains a variable resistor mechanism having a slider fastened to an operating shaft 15*a* of the operating member 15. The third casing 21 contains a rotary switch mechanism having a movable contact fastened to the operating shaft 15*a* of the operating member 15.

The operating member 15 may have an operating knob 15*b* as well as the operating shaft 15*a* and may be formed by machining a metal rod of electrically conductive material. Although described in details later, the operating member 15 reciprocally moves in its axial direction and also rotates about its axis. The operating shaft 15*a* has a non-circular cross section in order to allow such movement of the operating member 15.

The first casing 17 may comprise a case body 23 of electrically insulating resin and an electrically conductive base member 25 formed by aluminium die casting.

The base member 25 may have a pair of flanges 25*a*, 25*a* integrally provided therewith to engage ground electrodes E1, E1 on a surface of the circuit board 3, respectively. The flanges 25*a* may have a protrusion 25*b* integrally provided therewith so as to protrude outside thereof. The base member 25 has a pair of side walls 25*c*, 25*c* positioned on the flanges 25*a*, 25*a* thereof, an outer wall face 25*d* positioned on an upper face of the base member 25 or on a side of the operating knob 15*b* of the operating member 15 and an inner wall face 25*e* positioned on a lower face of the base member 25. The base member 25 is fitted in the case body 23 while the side walls 25*a* thereof are exposed out of the case body 23.

An electrically insulating sheet 27 is mounted on the outer wall face 25*d* of the base member 25. The insulating sheet 27 may have such a configuration that the outer wall face 25*d* of the base member 25 is covered all over with the insulating sheet 27. As shown in FIG. 1, the insulating sheet 27 may have recesses 27*b* and 27*c* formed therein and protrusions 27*d*, 27*d* integrally provided therewith. As also shown in FIG. 1, contact terminal portions 39*a* and 45*a* of connecting terminal members 39 and 45 which will be described later are-introduced into the recesses 27*b* and 27*c* in the insulating sheet 27. The protrusions 25*b* of the base member 25 provided on the flanges 25*a* thereof are covered with the protrusion 27*d* of the insulating sheet 27 as shown in FIG. 1. As shown in FIG. 1, the insulating sheet 27 may have two openings 27*f*, 27*f* provided therein. As also shown in FIG. 1, heads of connecting pins 57, 57 in the form of rivet described later are introduced into the openings 27*f* in the insulating sheet 27.

As shown in FIG. 3, the base member 25 may have a notched or rough surface provided on the inner wall face 25*e* thereof. A contact portion of a clicking slider 29 of electrically conductive material slidingly engages the notched surface of the base member 25. The operating shaft 15*a* of the operating member 15 extends through an extending hole 25*f* provided in the base member 25 at a center portion thereof. The clicking slider 29 may be mounted on a rotor 31 of electrically conductive metal. The clicking slider 29 is electrically connected to the rotor 31. The rotor 31 may comprise a hollow shaft portion 31*a* through which the operating shaft 15*a* extends and a sheet-like portion 31*b* on which the slider 29 is securely mounted. The operating shaft 15*a* can axially move, but cannot rotate within the hollow shaft portion 31*a* of the rotor 31. The hollow shaft portion 31*a* of the rotor 31 rotatably engages the insulating sheet 27 through an extending hole 27*a* provided therein. The sheet-like portion 31*b* of the rotor 31 may be provided with a stop portion which is adapted to engage a protrusion 23*b* provided on an inner wall portion of a bottom wall 23*a* of the case body 23 so that the rotor 31 can rotate only within a predetermined angular range. The operating shaft 15*a* extends through the bottom wall 23*a* of the case body 23 so that it can axially and rotatably move. The elements 23 through 31 constitute a click feeling generating block CB.

Thus, it will be noted that static electricity entering the first casing 17 through the operating shaft 15*a* of the operating member 15 can flow through the operating shaft 15*a*, the rotor 31, the slider 29 and the base member 25 to the ground electrodes E1 on the circuit board 3. This prevents the static electricity from flowing through the electric device mechanism contained in the second and third casings 19 and 21.

The second casing 19 containing the variable resistor mechanism may comprise a circuit board 33, a cylindrical body 35 of electrically insulating resin and a sheet-like portion 37*a* of a metal fitting member 37. A variable resistor pattern is formed by printing on a bottom face of the circuit board 33 (a lower face of the circuit board 33 as viewed in FIG. 3). A plurality of input or output electrodes may be also formed on the bottom face of the circuit board 33. Three connecting terminal members 39 at one end thereof may be soldered to the electrodes on the circuit board 33. The three connecting terminal members 39 extend upwardly along the surface of the case body 23 of the first casing 17 as shown in FIG. 3. Those portions of the three connecting terminal members 39 exposed from the first housing part 9 constitute respective contact terminal portions 39*a* thereof. The leading ends of the contact terminal portions 39*a* terminate within the recess 27*b* in the insulating sheet 27.

A rotor 43 of electrically insulating resin having a slider 41 mounted thereon is disposed within the second casing 19. The operating shaft 15*a* extends through the rotor 43 so as to axially move therethrough, but cannot rotate within the rotor 43. Thus, it will be noted that the rotor 43 can rotate together with the operating shaft 15*a*. The operating shaft 15*a* extends through the circuit board 33 so as to axially and rotatably move. The rotor 43 is disposed between the circuit board 33 and the sheet-like portion 37*a* of the metal fitting member 37 as shown in FIG. 3.

Figure 4:
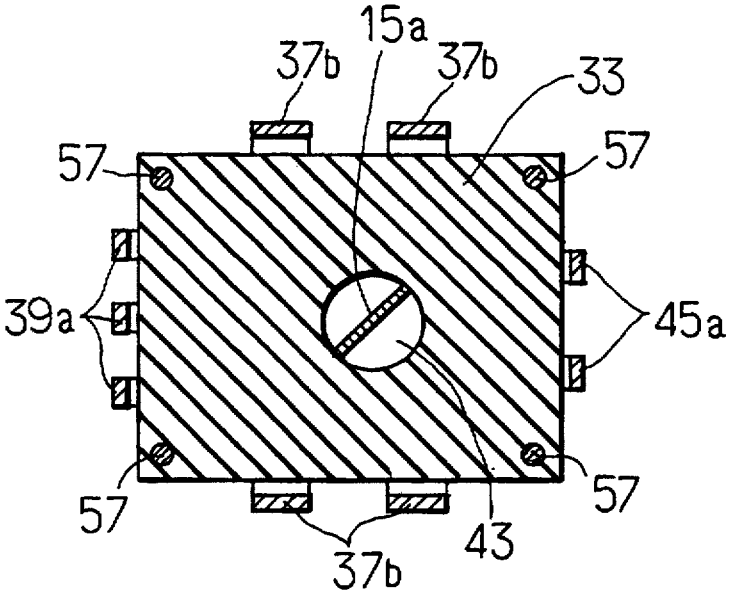
FIG. 4 is a horizontal cross sectional view of the electric device taken along a line IV—IV of FIG. 3.

As shown in FIGS. 1 and 4, the metal fitting member 37 has four engaging pieces 37*b* integrally provided therewith. The sheet-like portion 37*a* of the metal fitting member 37 may be in the rectangular form and the respective two engaging pieces 37*b* of the metal fitting member 37 extend from the two faced sides of the sheet-like portion 37*a* not corresponding to the other faced sides thereof, along one of which the three connecting terminal members 39 extend. The engaging pieces 37*b* may be formed by bending so as to provide a resilience thereto.

The engaging pieces 37*b* are so shaped that when the first housing part 9 is inserted through an electric device through hole H in the circuit board 3, the engaging pieces 37*b* engage the bottom face of the circuit board 3 after they extend through the electric device through hole H in the circuit board 3 while the circuit board 3 is positively held between the flanges 25*a* of the base member 25 and the engaging pieces 37*b*.

More particularly, the engaging pieces 37*b* may have a first portion 37*c* extending along the outer face of the first housing part 9, a second portion 37*d* extending integrally from the first portion 37*c* while being bent outwardly or far away from the outer face of the housing part 9 and a third portion 37*e* extending integrally from the second portion while being bent inwardly or toward the outer face of the housing part 9. The surface of the third portion 37*e* engages the bottom face of the circuit board 3. The second casing 19 and the variable resistor mechanism constitute a variable resistor block VRB.

As shown in FIG. 3, the third casing 21 containing the rotary switch mechanism may comprise an insulating base 47 of electrically insulating resin having two connecting terminal members 45 inserted thereinto when the base 47 is formed, a cylindrical body 49 of electrically insulating resin at one end closed by the insulating base 47 and a sheet-like member 51 of electrically insulating resin closing the cylindrical body 49 at another end thereof.

A stationary contact for the rotary switch mechanism is disposed on the insulating base 47 and a rotor 53 of the rotary switch mechanism formed of electrically insulating resin and mounted on the operating shaft 15*a* has a movable contact 55 securely provided thereon. Two connecting terminal members 45 at one end thereof are connected to the stationary contact on the insulating base 47. Those portions of the connecting terminal members 45 upwardly extending along the outer face of the first housing part 9 constitute contact terminal portions 45*a* thereof. The leading ends of the contact terminal portions terminate within the recess 27*c* in the insulating sheet 27. The operating shaft 15*a* extends through the rotor 53 so as to axially move, but cannot rotate within the rotor 53. Thus, it will be noted that the rotor 53 can rotate together with the operating shaft 15*a*. A rotation of the rotor 53 within a predetermined angular range causes the rotary switch mechanism to be turned on or off. A hollow shaft portion 53*a* of the rotor 53 is rotatably supported by the insulating base 47. The third casing 21 and the rotary switch mechanism contained therein constitute a switch block SB.

The second housing part 11 is provided on a bottom of the sheet-like portion 51 of the third casing 21, that is on a bottom of the first housing part 9.

The second housing part 11 may comprise a cylindrical portion 11*a* having an opening provided at one end thereof and a bottom provided at another end thereof and a flange 11*b* integrally provided with the cylindrical portion 11*a* at the opening thereof. The flange 11*b* of the second housing part 11 engages the sheet-like portion 51 of the third casing 21. The first housing part 9 and the flange 11*b* of the second housing part 11 may be connected by the four connecting pins 57 to each other as shown in FIGS. 1 and 4. The two ones of the four connecting pins 57 have the heads positioned at the insulating sheet 27 while the others have the heads positioned at the flange 11*b* of the second housing part 11.

The urging force generating mechanism applying an urging force to the operating member 15 contained within the second housing part 11 may be of such a conventional structure as disclosed in Japanese Patent Publication Nos. 33,621/1994, 85,442/1995 and 52,563/1985.

The urging force generating mechanism is adapted to generate such an urging force as causes the operating knob 15*b* of the operating member 15 to move from a first position indicated by a solid line of FIG. 1 to a second position indicated by an imaginary line of FIG. 1.

The urging force generating mechanism may include a spring member to generate an urging force and lock means to lock the operating shaft 15*a* from moving when it engages the operating shaft 15*a*. The spring member has energy stored when the operating knob 15*b* is pushed down from the second position to the first position. The lock means serves to hold the operating knob 15*b* at the first position by engaging the operating shaft 15*a* when the operating knob 15*b* is pushed down from the second position to the first position.

As the operating knob 15*b* is further pushed down from the first position, the lock means is unlocked and as a result, the operating member 15 is pushed up by the urging force which is provided by the energy stored in the spring member, which causes the operating knob 15*b* to move up to the second position.

Since the operating member 15 can rotate at either of the first and second positions of the operating knob 15*b*, the variable resistor can adjust its resistance and the rotary switch can be opened or closed even though the operating knob 15*b* is positioned at either of the first and second positions. As the operating knob 15*b* rotates, the click feeling is successively generated by the click feeling generating mechanism. The second housing part 11 and the interior components constitute an urging force generating block BB.

Figure 5:
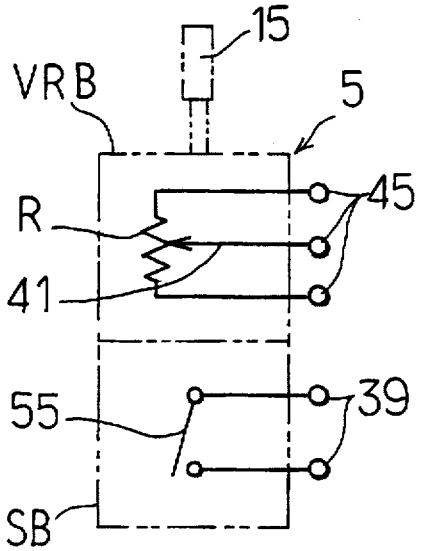
FIG. 5 is a schematic diagram of a circuit of the electric device used for the unit of FIG. 1.
Figure 6:
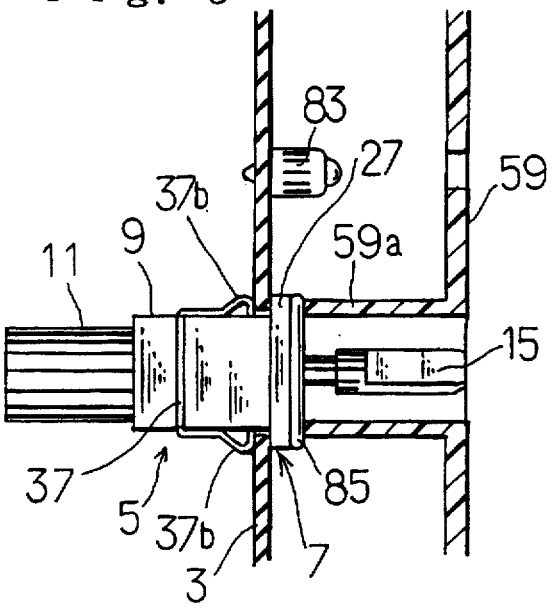
FIG. 6 is a cross sectional view of one unit of FIG. 1 being mounted on the circuit board in accordance with an example of the invention.

An electric circuit of the electric device 5 is as shown in FIG. 5. As the operating knob 15*b* rotates, the contacts of the switch block SB are opened and closed and at the same time the slider 41 of the variable resistor slides on a resistance body R within the variable resistor block VRB so that a value of resistance is adjusted. As shown in FIG. 6, means to axially move the operating member 15 is so constructed that the operating knob 15*b* is contained within an operating panel 59. As also shown in FIG. 6, the engaging pieces 37*b* of the metal fitting member 37 engage the bottom face of the circuit board 3.

Figure 7:
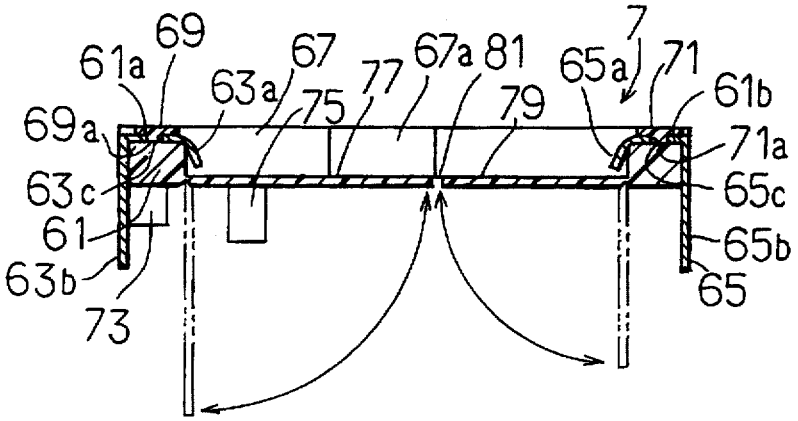
FIG. 7 is an enlarged cross sectional view of the socket used for the unit of FIG. 1.

As shown in FIGS. 1 and 7, the socket 7 may comprise a socket body 61 of electrically insulating resin mounted on the circuit board 3, three stationary terminal members 63 provided in the socket body 61 and two stationary terminal members 65 also provided in the socket body 61. The stationary terminal members 63 and 65 may have contact terminal portions 63*a* and 65*a*, respectively to engage the contact terminal portions 39*a* and 45*a* of the connecting terminal members 39 and 45 of the electric device and soldered terminal portions 63*b* and 65*b* extending through a plurality of through holes TH1 in the circuit board 3 for insertion of the terminal members and soldered to a soldering land (not shown) on the bottom of the circuit board 3.

The socket body 61 may have a device insertion hole 67 comprising a through hole through which the housing 13 of the electric device 5 extends. The socket body 61 may have a rectangular configuration. The socket body 61 may have recesses 67*a* formed therein so as to face the device through hole 67. The protrusions 25*b* of the base member 25 and the protrusions 27*d*, 27*d* of the insulating sheet 27 are introduced into the recesses 67*a*, 67*a* in the socket body 61, respectively. Since the protrusions 25*b* and 27*d* and the corresponding recesses 67*a*, 67*a* are formed so that they are displaced relative to the center of the sides of the electric device 5 and the center of the sides of the socket 7, the electric device 5 is advantageously prevented from being inserted into the socket 7 in an erroneous direction. The device insertion hole 67 may have such a configuration as the base member 25 of the electric device 5 slidingly engages the socket 7. Thus, with the electric device 5 inserted into the socket 7, the flanges 25*a* of the base member 25 engage the surface of the circuit board 3.

As shown in FIG. 7, the stationary terminal members 63 and 65 have through holes 63*c* and 65*c* formed adjacent to the contact terminal portions 63*a* and 65*a*. A fastening piece 69 of electrically insulating resin may have three projections 69*a* integrally formed on a bottom thereof and a fastening piece 71 may have two projections 71*a* integrally formed on a bottom thereof. The stationary terminal members 63 and 65 are mounted on the fastening pieces 69 and 71, respectively with the projections 69*a* and 71*a* fitted in the through holes 63*c* and 65*c*, respectively. The fastening pieces 69 and 71 having the stationary terminal members 63 and 65 thus mounted thereon, respectively, are welded to the socket body 61 at terminal fastening positions while they are fitted in terminal fastening recesses 61*a* and 61*b* provided in a pair of frames of the socket body 61, respectively. Thus, the stationary terminal members 63 and 65 are securely provided on the socket body 61. It will be noted that the stationary terminal members 63 and 65 may be provided on the socket body 61 by insert molding when the socket body 61 is formed, instead of securely provided by the fastening pieces 69 and 71.

The contact terminal portions 63*a* and 65*a* of the stationary terminal members 63 and 65 are so disposed that they are exposed in the device insertion hole 67 and partially project over the inner wall of the device insertion hole 67. More particularly, the contact terminal portions 63*a* and 65*a* of the stationary terminal members 63 and 65 are disposed along the two faced inner walls of the four inner walls of the socket body 61 surrounding the device insertion hole 67.

As shown in FIG. 1, the socket body 61 on the back face thereof or the face thereof engaging the circuit board 3 is provided with two cylindrical projections 73 and 73 which in turn extend through two through holes TH2 in the circuit board 3, respectively. The through holes TH2 and the projections 73 are so shaped that the socket body 61 is prevented from moving in a plane direction of the circuit board 3. The two projections 73 and 73 may be preferably provided on the socket body 61 at its corners and at its opposite positions in a diagonal direction. The projections 73 and 73 serve to accurately position the socket 7 on the circuit board 3. It should be noted that just a small number of projections can accurately position the socket 7 on the circuit board 3 when the two projections 73 and 73 are provided at the opposite corners of the socket body 61 in the diagonal direction. With the stationary terminal members 63 and 65 extending through the through holes TH1, the socket 7 can be roughly positioned. If no positioning projections are provided on the socket 7, there will be poor soldered connection of the stationary terminal members 63 and 65 to the soldering land of the circuit board 3 due to a high force applied to the soldered connection when a high force is applied to the socket 7. Two hooks 75 and 75 may be provided on the socket body 61 on a pair of frames thereof having no stationary terminal members 63 and 65 so as to face each other, although only one hook 75 is illustrated in FIG. 1. The two hooks 75 and 75 are fitted in engagement holes TH3 in the circuit board 3 communicating with the device through hole H so as to form an engagement portion 75*a* for preventing the socket 7 from being removed out of the circuit board 3.

Since the two hooks 75 and 75 are so provided that they are displaced relative to the center of the pair of faced frames of the socket body 61, the socket 7 is advantageously prevented from being mounted on the circuit board 3 in an erroneous direction. The hooks 75 and 75 prevent the socket 7 from moving upwardly far away from the circuit board 3 during the step of soldering the terminal members 63 and 65 to the circuit board 3. It is considered that the positioning protrusions 73 may be also in the form of hook, but if the protrusions 73 are in the form of hook, the through holes TH2 in the circuit board 3 have to be larger in their diameter. This causes larger gaps between the protrusions 73 and the through holes TH2 and as a result deteriorates an accuracy of position of the socket 7 relative to the circuit board 3.

As shown in FIG. 1, the socket 7 may be provided with two door-like members 77 and 79 forming a normally closed shutter which prevents a soldering flux from flowing through the device insertion hole 67 along the surfaces of the contact terminal portions 63*a* and 65*a* of the stationary terminal members 63 and 65 before the electric device 5 is inserted through the device insertion hole 67, but are forcibly opened by the electric device 5 when it is inserted through the device insertion hole 67.

The two door-like members 77 and 79 at one end thereof are connected to the socket body 61, but adapted to be pushed down by the electric device 5 and bent far away from the device insertion hole 67. The two door-like members 77 and 79 may be provided below the contact terminal portions 63*a* and 65*a* of the stationary terminal members 63 and 65 because they serve to prevent the soldering flux from flowing directly toward the contact terminal portions 63*a* and 65*a* of the stationary terminal members 63 and 65.

More particularly, the two door-like members 77 and 79 at one end thereof are integrally provided on lower portions of those two faced ones of four inner walls defining the device insertion hole 67 on which the contact terminal portions 63*a* and 65*a* are provided, respectively. Actually, the two door-like members 77 and 79 are so provided that the lower faces of the door-like members 77 and 79 have a plane substantially identical to a lower face of the socket body 61 engaging the circuit board 3. As noted from FIG. 1, the two door-like members 77 and 79 at their free ends are connected to each other by a breakable connection 81. The breakable connection 81 may be integrally formed with the door-like members 77 and 79.

The two door-like members 77 and 79 may be preferably connected to the socket body 61 so that they are forcibly opened far away from the device insertion hole 67 by the insertion of the electric device 5 without any removal of the door-like members 77 and 79 out of the socket body 61. This requires no operation of disposal of the door-like members 77 and 79 which will drop out of the socket body 61 if otherwise. Such door-like members 77 and 79 failing to drop out of the socket body 61 may be formed of resin such as polyamide resin hard to be cracked even though being bent. It should be noted that the door-like members 77 and 79 forming the shutter are required to be securely provided at a position where the engaging pieces 37*b* of the metal fitting member 37 for the electric device 5 is not prevented from engaging the bottom face of the circuit board 3.

A method of mounting the socket 7 on the circuit board 3 will be described herein just below. The socket 7 is inserted into the through hole H while the soldering terminal portions 63*b* and 65*b* of the stationary terminal members 63 and 65 on the socket 7 extend through the through holes TE1 in the circuit board 3, the protrusions 73 on the socket body 61 extend through the through holes TH2 in the circuit board 3 and the hooks 75 extend through the engaging holes TH3 in the circuit board 3.

Figure 8:
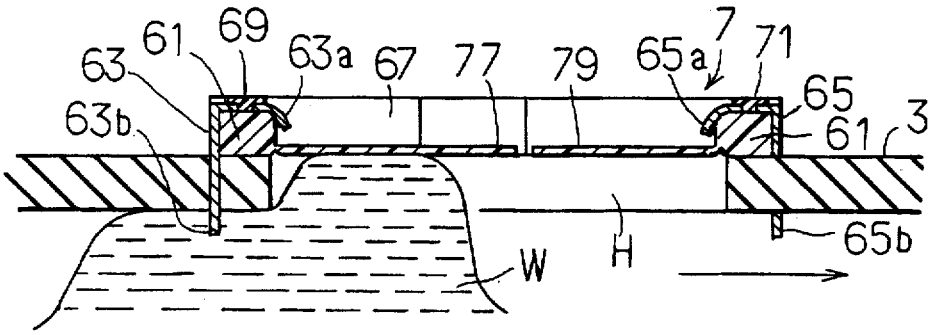
FIG. 8 is an enlarged cross sectional view of the socket used for the unit of FIG. 1 when it is soldered to the circuit board in an illustrative manner.

As shown in FIG. 8, the socket 7 extending through the through hole H in the circuit board 3 is soldered to the circuit board 3 by means of a suitable method such as a wave soldering method. Since the hooks 75 engage the edge wall of the engaging holes TH3 or the bottom face of the circuit board 3, the socket 7 is prevented from moving away from the surface of the circuit board 3 due to a jet stream of soldering flux or molten solder applied to the bottom face of the circuit board 3. After the jet stream of the soldering flux is applied to the bottom face of the circuit board 3, the jet stream of the molten solder is applied to the bottom face of the circuit board 3. Thus, the molten solder adheres to the soldering terminal portions 63*b* and 65*b* of the stationary terminal members 63 and 65 projecting from the bottom face of the circuit board 3 and also to the soldering land of the circuit board 3. A soldering resist layer in the form of insulating resin film is applied to the bottom face of the circuit board 3 excluding the soldering land.

The device insertion hole 67 in the socket body 61 at a lower portion thereof is shut or closed by the two door-like members 77 and 79. As shown in FIGS. 7 and 8, the two door-like members 77 and 79 are integrally connected to the socket body 61 below the contact terminal portions 63*a* and 65*a* of the stationary terminal members 63 and 65. Therefore, the flux or molten solder W is prevented from adhering directly to the contact terminal portions 63*a* and 65*a* of the stationary terminal members 63 and 65. The two door-like members 77 and 79 may be set enough to prevent the flux or molten solder W from sticking directly to the contact terminal portions 63*a* and 65*a*, but are not required to fully close the device insertion hole 67 at its lower opening.

After the socket 7 is mounted on the circuit board 3, the housing 13 of the electric device 5 is inserted into the device insertion hole 67 in the socket 7. The connection 81 of the two door members 77 and 79 are cut by the first housing part 11 inserted into the device insertion hole 67 in the socket body 61. As the electric device 5 is inserted into the device insertion hole 67, the two door-like members 77 and 79 are opened or bent while moving along the outer face of the housing 13 far away from the device insertion hole 67 or toward the through hole H provided in the circuit board 3 for the electric device 5. During inserting of the electric device 5 into the device insertion hole 67 in the socket body 61 and into the device through hole H in the circuit board 3, the engaging pieces 37b of the metal fitting member 37 for the electric device 5 slide on the inner wall of the device insertion hole 67 and the inner wall of the device through hole H while being deformed toward the surface of the first housing part 9. As the engaging pieces 37b extend the device insertion hole 67 and appear at the bottom face of the circuit board 3, the engaging pieces 37b of the metal fitting member 37 are returned so as to spread far away from the first housing part 9. Thus, the third portions 37e of the engaging pieces 37b engage the bottom face of the circuit board 3. In this condition, the flanges 25a of the metal fitting member 25 of the electric device 5 engage the surface of the circuit board 3 so that the circuit board 3 is held between the engaging pieces 37b of the metal fitting member 37 and the flanges 25a of the base member 25.

With the base member 25 and the insulating sheet 27 of the electric device 5 fitted in the device insertion hole 67, the contact terminal portions 39a and 45a of the connecting terminal members 39 and 45 on the electric device 5 and the contact terminal portions 63a and 65a of the stationary terminal members 63 and 65 on the socket 7 contact each other so that the electric device 5 is electrically connected to the socket 7.

As shown in FIG. 6, as the unit of the electric device is constructed in accordance with the invention, the electric device 5 can be mounted on the circuit board 3 while it partially projects from the bottom face of the circuit board 3 and the operating member 15 is disposed so as to extend in a direction perpendicular to the front face of the circuit board 3. Thus, with the circuit board 3 disposed substantially in parallel to the operating panel 59, a distance between the circuit board 3 and the operating panel 59 can be shortened. Particularly, in case that the operating member 15 moves between the first position and the second position as aforementioned, the distance between the circuit board 3 and the operating panel 59 can be shortened corresponding to a distance for which the operating knob 15b of the operating member 15 moves. Accordingly, an inner space of an electric instrument in which the electric device is used can be more effectively available.

On the circuit board 3 may be mounted a display element 83 such as a light emitting diode as well as the electric device 5. With the electric device of the invention mounted on the circuit board 3 provided in parallel to the operating panel 59, a light leakage prevention member 85 which may be formed of rubber or the like may be more easily disposed between the insulating sheet 27 of the electric device 5 and the cylindrical portion 59a integrally provided with the operating panel 59.

Figure 9:
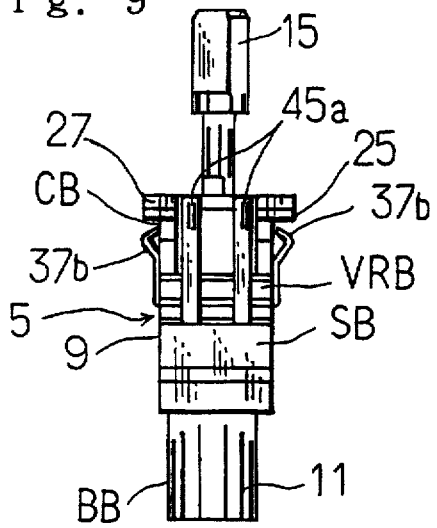
FIG. 9 illustrates an outline of the electric device used for the unit of FIG. 1 in a side elevational manner.
Figure 10:
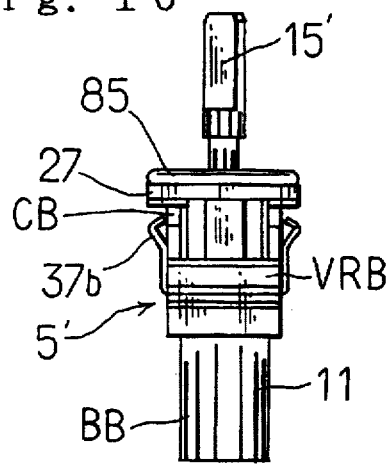
FIG. 10 illustrates an outline of an electric device constructed in accordance with another embodiment of the invention.

As shown in FIG. 9 in which the electric device 5 is illustrated as viewed from the side of the connecting terminal members 45, the electric device 5 is formed by integrally connecting the click feeling generating block CB, the variable resistor block VRB, the switch block SB and the urging force generating block BB by connecting members such as connecting pins. As shown in FIG. 10, the electric device 5' in the form of a variable resistor can be formed by removing the switch block SB out of the structure of FIG. 9 and shortening the operating shaft of the operating member 15'. As also shown in FIG. 10, the light leakage prevention member 85 may be mounted on the insulating sheet 27 of the electric device 5'.

Figure 11:
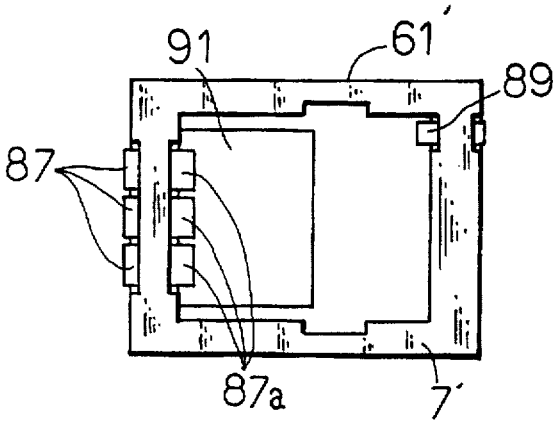
FIG. 11 illustrates an electric device constructed in accordance with further embodiment of the invention.

In the illustrated embodiment, since the stationary terminal members 63 and 65 are provided on the two faced frame portions of the socket body 61, the two door-like members 77 and 79 are required to be provided so as to prevent the flux and the solder from sticking to the contact terminal portions 63a and 65a of the stationary terminal members 63 and 65. However, as shown in FIG. 11, main stationary terminal members 87 may be provided on only one frame portion of a socket body 61' of a socket 7' and in this case, only one door-like member 91 may be provided on the socket body 61 below contact terminal portions 87a of the stationary terminal members 87. Although, in the embodiment illustrated in FIG. 11, a stationary terminal member 89 for a ground terminal may be provided on a frame portion of the socket body 61 faced to the frame portion on which the stationary terminal members 87 are provided, no door-like member is provided below the stationary terminal member 89.

In the embodiment of FIG. 11, after the socket 7' is mounted on the circuit board, the flux and the solder have to be scraped or removed out of the surface of the terminal member 89. The socket 7' of FIG. 11 may be used for mounting the electric device 5' of variable resistor as shown in FIG. 10 on the circuit board. The electric device 5' of FIG. 10 has no connecting terminal member positively provided to contact the terminal member 89 and the terminal member 89 contacts the flanges 25a of the base member 25.

The invention may be applied to an electric device such as one or combination of a toggle switch, a push-pull switch, a rotary switch, a variable capacity, a variable resistor and the likes.

Although, in the illustrated embodiment, the door-like members 77 and 79 may be provided on the socket body 61 because of the contact terminal portions 63a and 65a of the stationary terminal members on the socket disposed on the inner wall of the device insertion hole 67, no door-like members may be provided on the socket body 61 in case that the contact terminal portions of the stationary terminal members are positioned on the outer face of the socket body 61 or in case that the contact terminal portions of the stationary terminal members are not even partially positioned on the inner wall of the device insertion hole 67.

Although, in the illustrated embodiments, the operating members 15 and 15' may be axially movable, the invention may be applied to the electric device having an operating member which cannot axially move.

Although, in the illustrated embodiment, the door-like members for the shutter may be provided on the socket body so as not to be removed out of the socket body, they may be provided so as to be removed out of the socket body when the electric device is mounted on the socket.

There may be provided a shutter which is fitted in the device insertion hole on the lower side thereof so that the shutter is extruded by the electric device when it is mounted on the socket, instead of the door-like members integrally provided on the socket body.

There may be provided a thin sheet-like shutter of synthetic resin which is partially welded or jointed to the bottom face of the socket body or the face of the socket body facing the circuit board so that it is removed out of the socket body by the electric device inserted into the device insertion hole.

Although, in the illustrated embodiment, the metal fitting member 37 having engaging pieces 37b is separately provided from the housing, the metal fitting member 37 may be provided on the housing by being inserted into the case body 23 of the first casing, the insulating sheet 47 of the third casing 21 or the sheet member 51 when they are formed.

While some preferred embodiments of the invention have been described and illustrated with reference to the accompanying drawings, it will be understood by those skilled in the art that those are by way of examples, and that various changes and modifications may be made without departing from the spirit and scope of the invention, which is intended to be defined only to the appended claims.

What is claimed is:

1. A socket type electric device unit comprising;

an electric device including an operating member, at least one electric device mechanism having an electric characteristic or condition varied by said operating member, and a plurality of connecting terminal members each having a contact terminal portion exposed outside thereof and electrically connected to each one of a plurality of input or output electrodes on said electric device mechanism;

a socket including a socket body to be mounted on a circuit board, a plurality of stationary terminal members provided on said socket body and having contact terminal portions to contact said contact terminal portions of said connecting terminal members and a soldering terminal portion to be soldered to a soldering land of said circuit board, and a device insertion hole provided in said socket body and into which said electric device is to be at least partially inserted;

said device insertion hole in said socket body being formed of a hole through which said electric device is to partially extend;

said socket body of said socket being provided with a plurality of protrusions which is to engage a plurality of through holes provided in said circuit board whereby said socket is positioned relative to said circuit board;

and thereby said contact terminal portions of said plurality of connecting terminal members and said contact terminal portions of said plurality of stationary terminal members contacting each other when said electric device is partially inserted into said device insertion hole and into a device through hole in said circuit board.

2. A socket type electric device unit as set forth in claim 1;

wherein said socket body is in a rectangular form, and wherein said protrusions are integrally provided on said socket body so as to be positioned a pair of corners of said socket body on a diagonal line.

3. A socket type electric device unit as set forth in claim 1 or 2;

and wherein at least one hook is integrally provided on said socket body, said hook having an engagement portion to engage an edge of at least one engagement hole provided in said circuit board whereby said socket is prevented from being removed out of said circuit board.

4. A socket type electric device unit as set forth in claim 1;

said electric device further including a click feeling generating mechanism generating a tactile feeling as said operating member rotates;

and said click feeling generating mechanism and said electric device mechanism being contained in separate casings, respectively, which are connected and fixed to each other by connector means.

5. A socket type electric device unit comprising;

an electric device including a housing, an operating member having an a shaft portion extending within said housing and an operating portion positioned outside of said housing, at least one electric device mechanism contained in said housing and having an electric characteristic or condition varied by said operating member, and a plurality of connecting terminal members each having a contact terminal portion exposed outside thereof and electrically connected to each one of a plurality of input or output electrodes on said electric device mechanism;

a socket including a socket body mounted on a circuit board, a plurality of stationary terminal members provided on said socket body and each having a contact terminal portion to contact each of said contact terminal portions of said connecting terminal members and a soldering terminal portion to be soldered to a soldering land of said circuit board, and a device insertion hole provided in said socket body and into which said electric device is to be at least partially inserted;

said device insertion hole in said socket body being formed of a hole through which said housing of said electric device is to partially extend;

said socket body of said socket being provided with a pair of protrusions which is to engage a pair of through holes provided in said circuit board whereby said socket is positioned relative to said circuit board;

at least one hook being integrally provided on said socket body, said hook having an engagement portion to engage an edge of at least one engagement hole communicating with device through hole provided in said circuit board whereby said socket is prevented from being removed out of said circuit board;

and thereby said contact terminal portions of said plurality of connecting terminal members and said contact terminal portions of said plurality of stationary terminal members engaging each other when said housing of said electric device is partially inserted into said device insertion hole and into said device through hole in said circuit board.

6. A socket type electric device unit as set forth in claim 5;

said housing comprising a first housing part in which said at least one electric device is contained and a second housing part disposed under said first housing part and which contains an urging force generating mechanism to apply an urging force to said operating member;

said first housing part including a combination of a casing which contains a click feeling generating mechanism to generate a click feeling as said operating member rotates and casings in which said at least one electric device mechanism is contained;

and said casings and said second housing part being connected and fixed to each other by connector means.

7. A socket type electric device unit as set forth in claim 6;

and wherein said at least one electric device mechanism including a variable resistor mechanism having a slider fastened to said operating shaft of said operating member and a rotary switch mechanism having a movable contact fastened to said operating shaft.

8. A socket type electric device unit as set forth in claim 5;

said housing including a metal base member having at least one flange to contact a surface of said circuit board facing said operating portion;

and said housing having a plurality of engaging portions provided thereon and adapted to be able to extend through said device insertion hole in said socket body and through said device through hole in said circuit board to engage a bottom face of said circuit board so as to hold said circuit board between said engaging portions and said flange of said base member.

9. A socket type electric device unit as set forth in claim 8;

said shaft portion of said operating member being formed of electrically conductive material;

and said shaft portion of said operating member and said base member being electrically connected to each other.

10. A socket type electric device unit as set forth in claim 9;

said base member partially forming said click feeling generating mechanism and a part of said casing for containing said click feeling generating mechanism;

said base member having a rough face formed thereon and on which a contact of a clicking slider of electrically conductive material slidingly moves;

and said clicking slider being provided on said operating member so as to be electrically connected to a rotor of electrically conductive material securely provided on said operating shaft.

11. A socket type electric device unit comprising;

an electric device including a housing, an operating member having an a shaft portion extending through said housing and an operating portion positioned outside of said housing, at least one electric device mechanism contained in said housing and having an electric characteristic or condition varied by said operating member, and a plurality of connecting terminal members each having a contact terminal portion exposed outside thereof and electrically connected to each one of a plurality of input or output electrodes on said electric device mechanism;

a socket including a socket body of electrically insulating resin mounted on a circuit board, a plurality of stationary terminal members provided on said socket body and having contact terminal portions to contact said contact terminal portions of said connecting terminal members and a soldering terminal portion to be soldered to a soldering land of said circuit board and a device insertion hole provided in said socket body and into which said electric device is to be at least partially inserted;

said contact terminal portions of said plurality of connecting terminal members and said contact terminal portions of said plurality of stationary terminal members contacting each other when said housing of said electric device is inserted into said device insertion hole;

said device insertion hole in said socket body being formed of a hole through which said housing of said electric device is to partially extend;

said socket body of said socket being provided with a shutter to prevent a soldering flux from flowing through said device insertion hole along surfaces of said contact terminal portions of said plurality of stationary terminal members before said electric device is inserted into said device insertion hole, but to be forcibly opened by said electric device when it is inserted into said device insertion hole.

12. A socket type electric device unit as set forth in claim 11;

at least part of said contact terminal portions of said plurality of stationary terminal members on said socket being positioned within said device insertion hole;

and said shutter being provided below said contact terminal portions of said plurality of stationary terminal members so as to prevent said soldering flux from flowing directly toward said contact terminal portions of said plurality of stationary terminal members.

13. A socket type electric device unit as set forth in claim 12;

said shutter comprising at lease one door-like member integrally formed together with said socket body;

and said at least one door-like member being connected to said socket body so as not to be removed out of said socket body when said door-like member is forcibly opened by said electric device in a direction in which said door-like member moves far away from said device insertion hole.

14. A socket type electric device unit as set forth in claim 13;

said shutter comprising two door-like members securely provided on said socket body so as to substantially close said device insertion hole;

and said two door-like members being connected to said socket body so as not to be removed out of said socket body when said door-like members are forcibly opened by said electric device in a direction in which said door-like members move far away from said device insertion hole.

15. A socket type electric device unit as set forth in claim 14;

said contact terminal portions of said plurality of stationary terminal members provided on said socket body being disposed along two faced ones of inner walls defining said device insertion hole;

said two door-like members being securely provided at lower area of said faced inner walls of said device insertion hole;

and said two door-like members being connected to each other by a breakable connection.

16. A socket on which is mounted an electric device comprising a plurality of connecting terminal members each having a contact terminal portion exposed out of a housing, said socket comprising;

a socket body of electrically insulating resin to be mounted on a circuit board;

a plurality of stationary terminal members provided on said socket body and each having a contact terminal portion to contact each of said contact terminal portions of said connecting terminal members and a soldering terminal portion to be soldered to a soldering land of said circuit board;

and a device insertion hole provided in said socket body and into which said electric device is to be at least partially inserted;

said contact terminal portions of said plurality of connecting terminal members and said contact terminal portions of said plurality of stationary terminal members being provided so as to contact with each other when said housing of said electric device is inserted into said device insertion hole;

said device insertion hole in said socket body being formed of a hole through which said housing of said electric device is to partially extend;

said socket body of said socket being integrally provided with a shutter to prevent a soldering flux from flowing through said device insertion hole along surfaces of said contact terminal portions of said plurality of stationary terminal members before said electric device is inserted into said device insertion hole, but to be forcibly opened by said electric device when it is inserted into said device insertion hole.

17. An electric device to be mounted an a socket which is in turn to be mounted on a circuit board, said electric device comprising a housing, an operating member having a shaft portion extending within said housing and an operating portion positioned outside of said housing, at least one electric device mechanism contained in said housing and having an electric characteristic or condition varied by said operating member and a plurality of connecting terminal members each having a contact terminal portion exposed outside and electrically connected to each one of a plurality of input or output electrodes on said electric device mechanism;

said housing comprising a first housing part in which said at least one electric device is contained and a second housing part disposed under said first housing part and in which is contained an urging force generating mechanism to apply an urging force to said operating member;

said first housing part including a metal base member having at least one flange to engage a surface of said circuit board facing said operating portion;

and said first housing part having a plurality of engaging portions provided thereon and adapted to be able to extend through said device insertion hole in said socket body and through said device through hole in said circuit board to engage a bottom face of said circuit board so as to hold said circuit board between said engaging portions and said flange of said base member.

* * * * *

UNITED STATES PATENT AND TRADEMARK OFFICE

CERTIFICATE OF CORRECTION

PATENT NO. : 5,711,680

DATED : January 27, 1998

INVENTOR(S) : Tadayoshi Tsuneaki et al.

It is certified that error appears in the above-identified patent and that said Letters Patent is hereby corrected as shown below:

Claim 13, line 3, after "at", delete "lease" and insert --least--.

Claim 17, line 1, after "mounted", delete "an" and insert --on--.

Signed and Sealed this

Eleventh Day of August 1998

Bruce Lehman

*Attest:*

BRUCE LEHMAN

*Attesting Officer*

*Commissioner of Patents and Trademarks*